US007503841B2

(12) United States Patent
Rho

(10) Patent No.: US 7,503,841 B2
(45) Date of Patent: Mar. 17, 2009

(54) PARALLELOGRAM COUNTER

(76) Inventor: Eun-Rae Rho, 230-32, Yeonmu-dong Jangan-gu, Suwon-si, Kyeonggi-do, 440-811 (KR)

( * ) Notice: Subject to any disclaimer, the term of this patent is extended or adjusted under 35 U.S.C. 154(b) by 532 days.

(21) Appl. No.: 11/384,221

(22) Filed: Mar. 17, 2006

(65) Prior Publication Data

US 2006/0283762 A1 Dec. 21, 2006

(30) Foreign Application Priority Data

Mar. 18, 2005 (KR) ..... 20-2005-0007354 U

(51) Int. Cl.
*G07D 9/00* (2006.01)

(52) U.S. Cl. ..... 453/60; 453/58

(58) Field of Classification Search ..... 206/540, 206/559, 528–539; 434/188, 195, 200, 205, 434/211; 33/121, 430, 437, 664, 1 V, 122; 453/58, 60; 235/60 C, 66; 248/441.1, 442.2, 248/447; 422/63, 102

See application file for complete search history.

(56) References Cited

U.S. PATENT DOCUMENTS 4,121,722 A * 10/1978 Sussman ..... 414/675

* cited by examiner

*Primary Examiner*—Patrick H Mackey
*Assistant Examiner*—Jeffrey A Shapiro

(74) *Attorney, Agent, or Firm*—Ladas & Parry LLP

(57) ABSTRACT

Provided is a parallelogram counter for counting pills swiftly and conveniently in a drugstore. The parallelogram counter includes: a parallelogram counting plate on which a transverse flange, a first longitudinal flange, and a second longitudinal flange are protrudingly formed; a slidable transverse flange which is formed in parallel with the transverse flange, and movably fixed up and down; a reference point; a reference line which is formed by connecting the reference point with the outer side of a last pill among a reference number of pills which are arranged along the side surface of the first longitudinal flange; and a recollector outlet. The parallelogram counter further includes a guide plate on which two guides are protrudingly formed at the left side of the first longitudinal flange, a fixed protrusion which is integrally formed in the slidably transverse flange and is movably formed up and down between the two guides, and a number of indication lines which are formed by connecting the reference point and a number of points located at the lower edge of the parallelogram counting plate and located at the left side of the second longitudinal flange, and a fixed slidable longitudinal flange which is formed in parallel with the first and second flanges and movably fixed left and right.

9 Claims, 9 Drawing Sheets

PARALLELOGRAM COUNTER

CROSS-REFERENCE TO RELATED PATENT APPLICATION

This application claims the benefit of Korean Utility Model Registration Application No. 20-2005-0007354, filed on Mar. 18, 2005, in the Korean Intellectual Property Office, the disclosure of which is incorporated herein in its entirety by reference.

BACKGROUND OF THE INVENTION

1. Field of the Invention

The present invention relates to a parallelogram counter, and more particularly, to a parallelogram counter for counting small components such as tablet type pills,bolus, and coins, quickly, conveniently, and sanitarily.

2. Description of the Related Art

Since the adult's chronic disease in a circulatory system or an endocrine system increases including the hypertension, the diabetes, and the arteriosclerosis, the hyperlipidemia, etc., a large number of pills should be counted to prescribe medicines to a patient.

Therefore, a pharmacist should count and classify pills one by one to meet the whole dosage for individual medicines needed according to a doctor's prescription, in a pharmacy. The counted and classified pills are re-classified again into unit doses to prescribe medicine to a patient for numerous. The pharmacist may take or feel with pains. Particularly, the pharmacist may feel the mental oppressive sensation that he or she should count pills or capsules quickly and exactly at a state where patients await. Further, when the pharmacist dispenses medicines as described above, a hygienic problem such as contagion due to the bacteria or virus may occur.

In the meantime, as the conventional art, a device such as a triangular counter, a groove type counter, or an automatic counter has been being used in order to count pills in a pharmacy.

The triangular counter is configured so that an angle between two flanges becomes 60 degrees. Accordingly, when pills are contained in the triangular counter and then shaken to the right and left, a hexagonal arrangement is achieved so that the pills occupy the minimum area at the least. As can be seen from the following Table 1, the pills form an arrangement that the number of pills increase by one everytime when the number of lines increases by one. In this case, the arrangement follows a certain rule. People may think that it is easy to count pills due to the above-described features of the triangular counter. However, it is not so easy to count the pills, or the number of lines of pills with the eyes due to repetition of identical shapes. Further, as the number of lines increases, the number of pills per line increases, to thereby demand a high-degree concentration in order to determine the total number of the pills.

TABLE 1

Arrangement of The number of Pills in Triangular Counter.

| | | | | | | | | |
|---|---|---|---|---|---|---|---|---|
| The number of Lines | 1 | 2 | 3 | 4 | . . . | 8 | 9 | 10 |
| The number of pills per line | 1 | 2 | 3 | 4 | . . . | 8 | 9 | 10 |
| The total number of pills | 1 | 3 | 6 | 10 | . . . | 36 | 45 | 55 |

In the meantime, a groove type counter is disclosed in a Korean Utility Model Registration No. 20-0232780. Here, a number of circular grooves having a certain shape or size are formed in the groove type counter according to size of pills.

Accordingly, only pills can be filled in the circular grooves. As a result, the number of pills can be calculated according to the number of the circular grooves. However, the conventional groove type counter should be changed according to the size of pills. Also, pills should be filled in the grooves. In the case that pills are counted more than the number of grooves, a counting work should be repeated. That is, inconveniences of the counting work are not completely solved.

In order to solve the above-described defects, an automatic counter has been developed so that the number of pills can be calculated regardless of the sizes and shapes of pills at fast speeds. However, since such an automatic counter is very expensive, it is not substantially widely provided to even a small scale pharmacy.

Besides, various types of tablet counting devices are known. For example, the following U.S. patents describe various types of tablet counting devices.

U.S. Pat. No. 2,530,009 to M. R. Fields on Nov. 14, 1950 entitled "Tablet counting device"

U.S. Pat. No. 2,952,369 to R. S. Rew on Sep. 13, 1960 entitled "Pill counter"

U.S. Pat. No. 4,047,620 to W. L. Deininger on Sep. 13, 1977 entitled "Pill and capsule counter"

U.S. Pat. No. 4,121,722 to Sussman et al. on Oct. 24, 1978 entitled "Unit counter for pills, tablets, spheres, coins and the like"

U.S. Pat. No. 4,597,091 to David J. Blake on Jun. 24, 1986 entitled "Pill counter"

U.S. Pat. No. 6,821,079 to Robert N. Probe et al. on Nov. 23, 2004 entitled "Pill and capsule counter"

While some of the objects and the structural arrangements of the above described devices, at first appearance, have similarities with the present invention, they differ in shape and function respects. These differences, which will be described in more detail hereinafter, are essential for the effective use of the invention and which admit of the advantages that are not available with the prior devices.

Therefore, to solve the above-described problems, a counting device which can count pills quickly and conveniently regardless of the size of the pills need to be developed.

SUMMARY OF THE INVENTION

To solve the above problems of the conventional art, it is an object of the present invention to provide a parallelogram counter with which a user such as a pharmacist can count the number of pills regardless of size of tablet type pills quickly, conveniently and sanitarily, in a pharmacy.

It is another object of the present invention to provide a parallelogram counter which can count the number of circular or disk-shaped beads or coins, quickly or conveniently.

To accomplish the above object of the present invention, there is provided a parallelogram counter comprising: a parallelogram counting plate whose interior angles are sixty degrees or one-hundred twenty degrees, on which a transverse flange, a first longitudinal flange, and a second longitudinal flange are protrudingly formed at the upper portion, the left-hand portion, and the right-hand portion of the parallelogram counter, respectively; a slidable transverse flange which is formed in parallel with the transverse flange, so that the first longitudinal flange is inserted into a throughhole formed on the left-hand side of the slidable transverse flange and the slidable transverse flange is slidably moved up and down along the first longitudinal flange; a reference point at which the transverse flange and the first longitudinal flange meet; a reference line which is formed by connecting the reference point with the outer side of a last pill among a reference number of pills which are arranged along the side surface of the first longitudinal flange; and a recollection outlet which is formed between the transverse flange and the second longitudinal flange.

In the case of the parallelogram counter according to the present invention, a guide plate where two guides are protrudingly formed so that one is formed at the left-hand side in parallel with the first longitudinal flange and the other is formed at the left-hand side of the one guide and spaced by an interval between the first longitudinal flange and the reference line, may be applied instead of the reference line, and a fixed protrusion which is located between the two guides, and is integrally formed in the slidable transverse flange.

Moreover, the parallelogram counter according to the present invention further comprises a number of indication lines which are obtained by continuously drawing straight lines connecting points at which pills of a certain number are arranged to the right side from the vertex 15 in which the upper surface of the slidable transverse flange and the right-hand surface of the first longitudinal flange with the reference point, up to the lower end of the counting plate.

Moreover, the parallelogram counter according to the present invention further comprises a slidable transverse plate which moves to the left and right along the slidable transverse flange, and a slidable longitudinal flange which is formed between the slidable transverse flange and the counting plate in parallel with the first longitudinal flange, and combined with the slidable transverse plate so as to be movable to the left and right.

In the present invention, it is more preferable that the interior angle of the parallelogram counter is one-hundred twenty degrees, in view of convenience of use. An ordinary tool such as a brush or a scoop can be used as a recollector. Here, a brush is more desirable. Also, the recollector may be chained on the counting plate or connected to the counting plate with a string in use.

In the present invention, the recollection outlet may be fabricated in the form of a vessel separately according to an ordinary method. In this case, the vessel-shaped recollection outlet can be more conveniently used when preparing a medicine.

Thus, when the parallelogram counting plate and the slidable transverse flange are used in the present invention, a certain number of pills per line are arranged irrespective of the size of the pills. As a result, since pills can be counted quickly and conveniently, the counted pills are put into bottles for drug through the recollection outlet, and used for prescription for medicines, to thereby greatly shorten a time and effort which is required for prescription or dosage of medicines in a pharmacy.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

A parallelogram counter according to a preferred embodiment of the present invention will be described with reference to the accompanying drawings.

Figure 1:
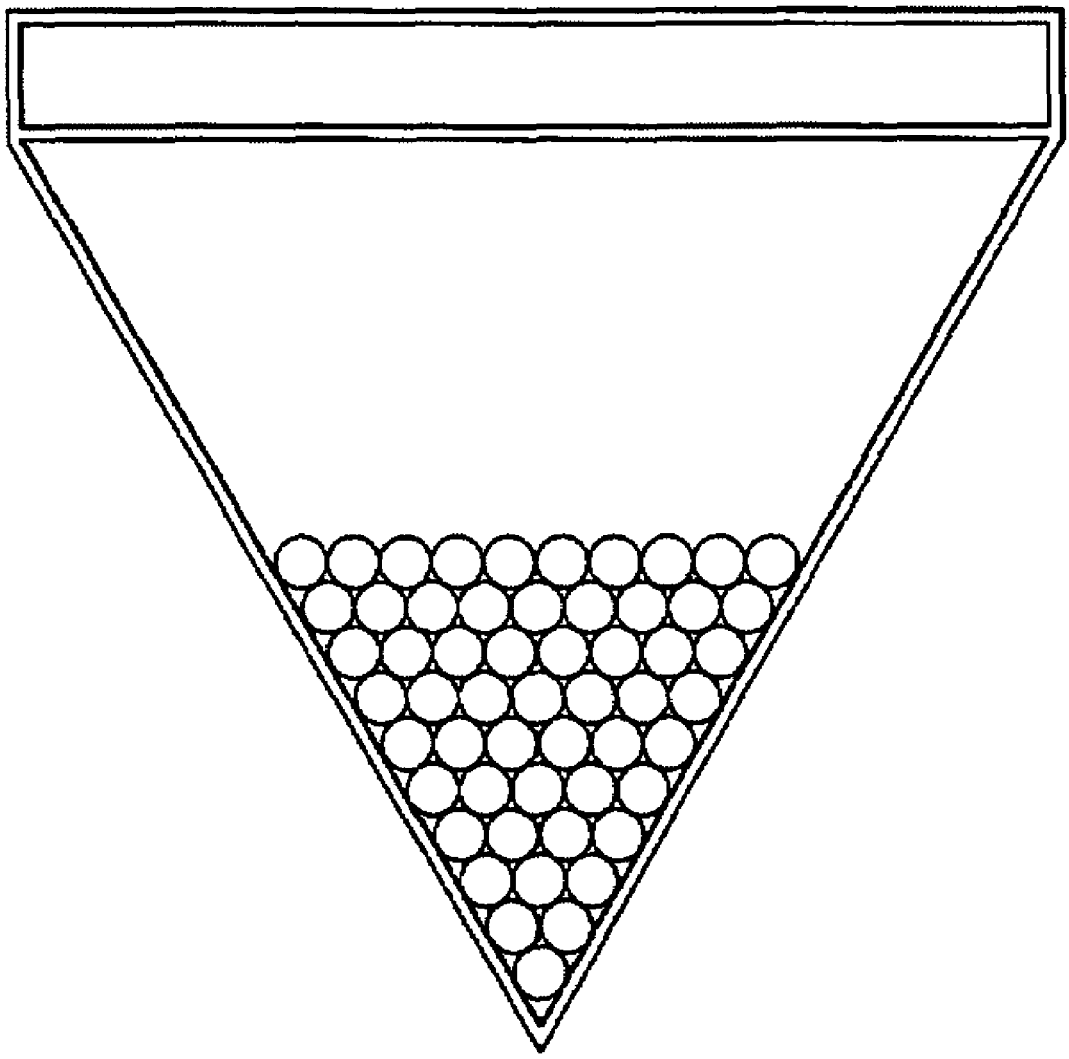
FIG. 1 (PRIOR ART)
FIG. 1 is a front view showing a conventional triangular counter.

FIG. 1 is a front view showing a conventional triangular counter. In this case, since the number of pills differs in every line, it has the disadvantage that the total number of pills cannot be confirmed conveniently.

Figure 2A:
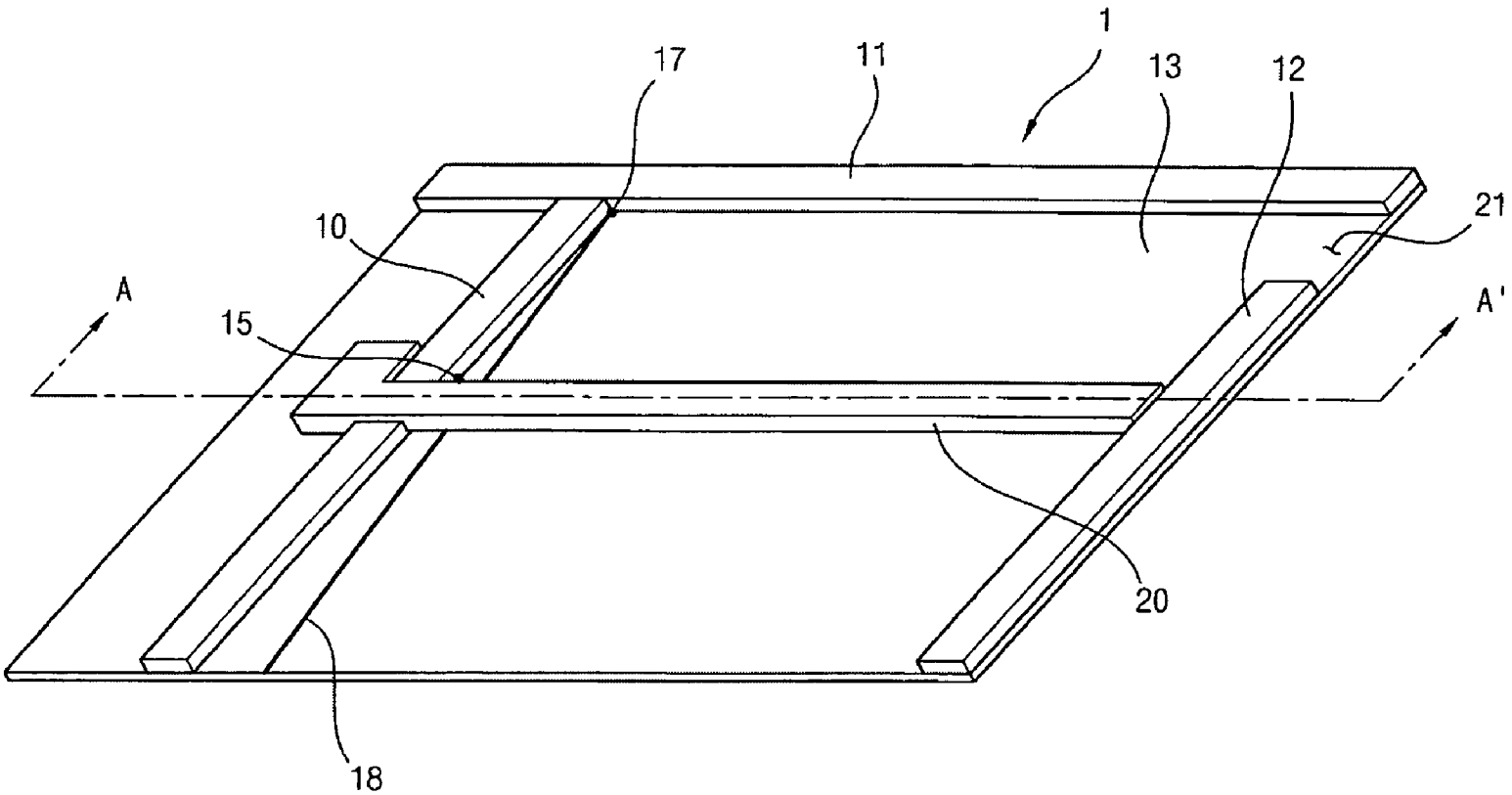
FIG. 2A is a perspective view showing a parallelogram counter on which a slidable transverse flange is installed, according to an embodiment of the present invention.
Figure 2B:
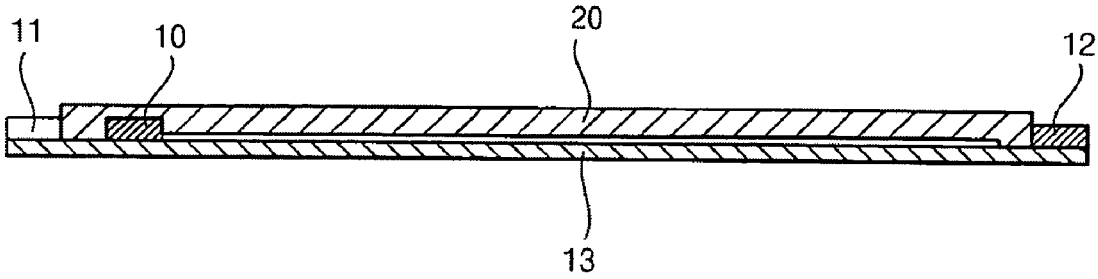
FIG. 2B is a cross-sectional view of a line A-A' of FIG. 2A.
Figure 2C:
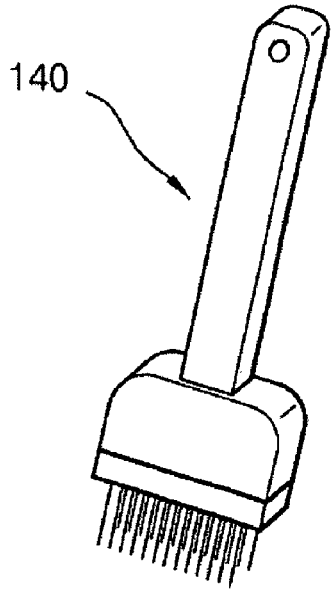
FIG. 2C is a perspective view showing a brush which is a recollector according to the present invention.

FIG. 2A is a perspective view showing a parallelogram counter on which a slidable transverse flange is installed, according to an embodiment of the present invention. FIG. 2B is a cross-sectional view of a line A-A' of FIG. 2A. FIG. 2C is a perspective view showing a brush which is a recollector 140 according to the present invention.

A transverse flange 11 and a first longitudinal flange 10 which form an interior angle of one-hundred twenty degrees at a reference point 17 at which the transverse flange 11 and the first longitudinal flange 10 meet, are protrudingly formed at the upper portion and the left-hand side of a parallelogram counting plate 13, and a second longitudinal flange 12 is protrudingly formed at the right side of the counting plate 13. A reference line 18 is formed by connecting the reference point 17 with the outer side of a last pill among a reference number of pills which are arranged from the reference point 17 along the right-hand surface of the first longitudinal flange 10. The reference line 18 is indicated by the lower end of the counting plate 13. A slidable transverse flange 20 is formed in parallel with the transverse flange 11. The crosssection of the left-hand portion of the slidable transverse flange 20 is formed of a "C-shaped hole, into which the first longitudinal flange 10 is inserted. Thus, the slidable transverse flange 20 moves up and down along the first longitudinal flange 10.

A brush 140 is illustrated as a separate recollection tool, independently of the counting plate 13.

In order to count pills they are put on the vertex 15 which is a contact point of the slidable transverse flange 20 and the first longitudinal flange 10. The slidable transverse flange 20 is moved up and down. Then, the slidable transverse flange 20 is fixed to a location at which the outer side of the pills contacts the reference line 18. In this case, a reference number of pills are always aligned on the right-hand surface of the first longitudinal flange 10. If the reference line 18 is drawn assuming that the reference number is ten, ten pills are always arranged along the first line contacting the first longitudinal flange 10. Thus, ten pills are likewise arranged along a respective line of the second, third, fourth and fifth lines. Accordingly, it can be easily seen that the number of the whole pills is one-hundred fifty (10×5=150) if the pills are arranged along the fifteen lines. As a result, the total number of the arranged pills can be obtained very simply and conveniently. Also, the counted pills can be sanitarily recollected via a recollection outlet 21 using a brush 140 which is a recollector.

Figure 3:
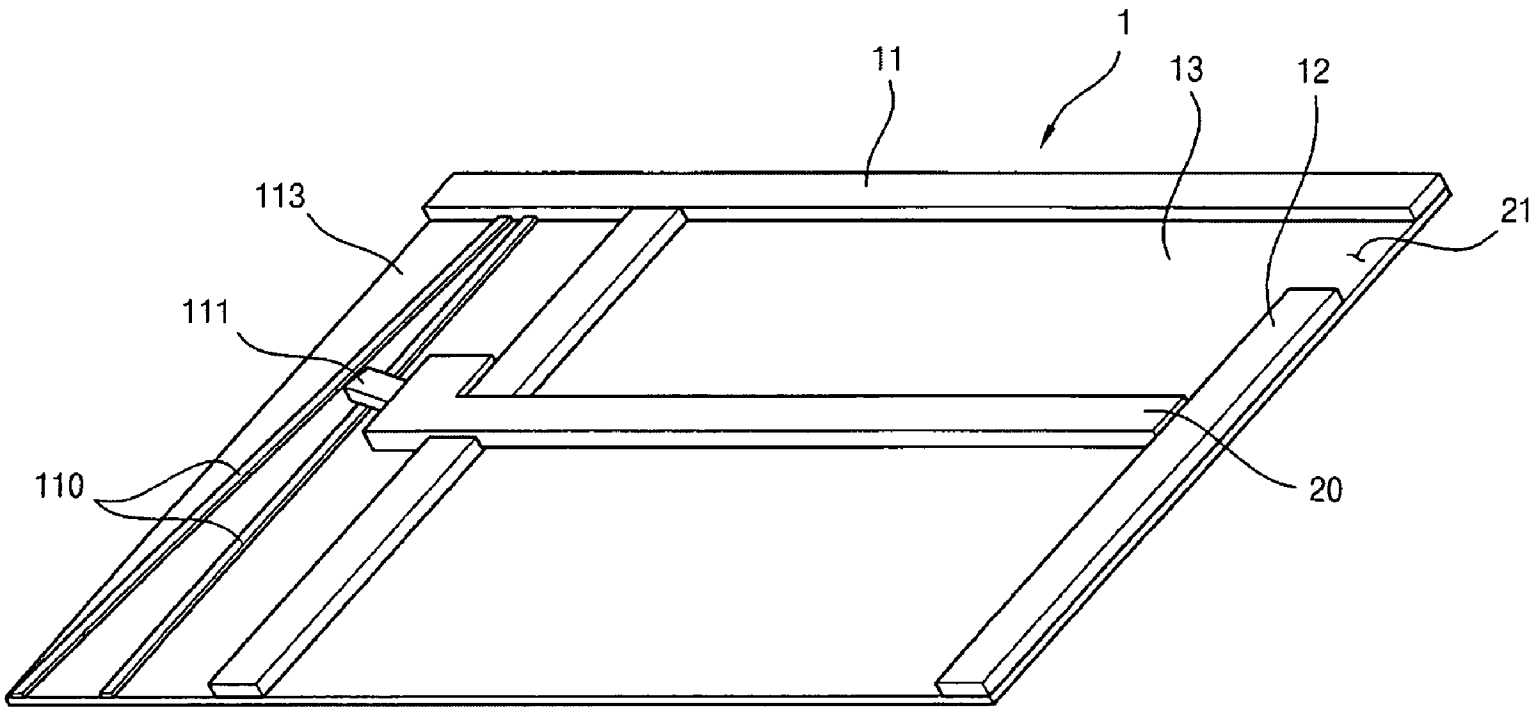
FIG. 3 is a perspective view of a parallelogram counter in which a guide plate and a fixed protrusion are mounted according to another embodiment of the present invention.

FIG. 3 is a perspective view of a parallelogram counter in which a guide plate and a fixed protrusion according to the present invention are mounted. Of two guides 110 which are protrudingly formed on a guide plate 113, one is formed at the left-hand side in parallel with the first longitudinal flange 10 and the other is formed at the left-hand side of the one guide and spaced by an interval between the first longitudinal flange 10 and the reference line 18. A fixed protrusion 111 is located between the two guides 110, and is integrally formed in the slidable transverse flange 20, so as to movable up and down together with the slidable transverse flange 20.

The accurate locations of the left-hand guide 110 and the fixed protrusion 111 are determined as follows. That is, pills are put between the two guides 110, and then the pills are moved upwards by the fixed protrusion 111 using the fixed protrusion 111 and the slidable transverse flange 20. In this case, the location of the slidable transverse flange 20 when the fixed protrusion 111 stops should be same as that of the slidable transverse flange 20 when a certain number of pills are arranged in a line at the right-hand side of the first longitudinal flange 10. Thus, since the location of the slidable transverse flange 20 should be same as that of the slidable transverse flange 20 when the outer side of the pills put on the vertex 15 contacts the reference line 18, the location of the fixed protrusion 111 may be properly determined or the location of the left-hand guide 110 may be properly determined.

The fixed protrusion 111 designates the location of the slidable transverse flange 20 in which the pills of a reference number are arranged in a line according to the size (or diameter) of the pills. The slidable transverse flange 20 is automatically fixed by only putting pills between the two guides 110 and then pushing up the fixed protrusion 111 to be fixed. Thus, there is no need to make the slidable transverse flange 20 move to a spot in which the outer side of the pills coincides with the reference line 18.

Figure 4:
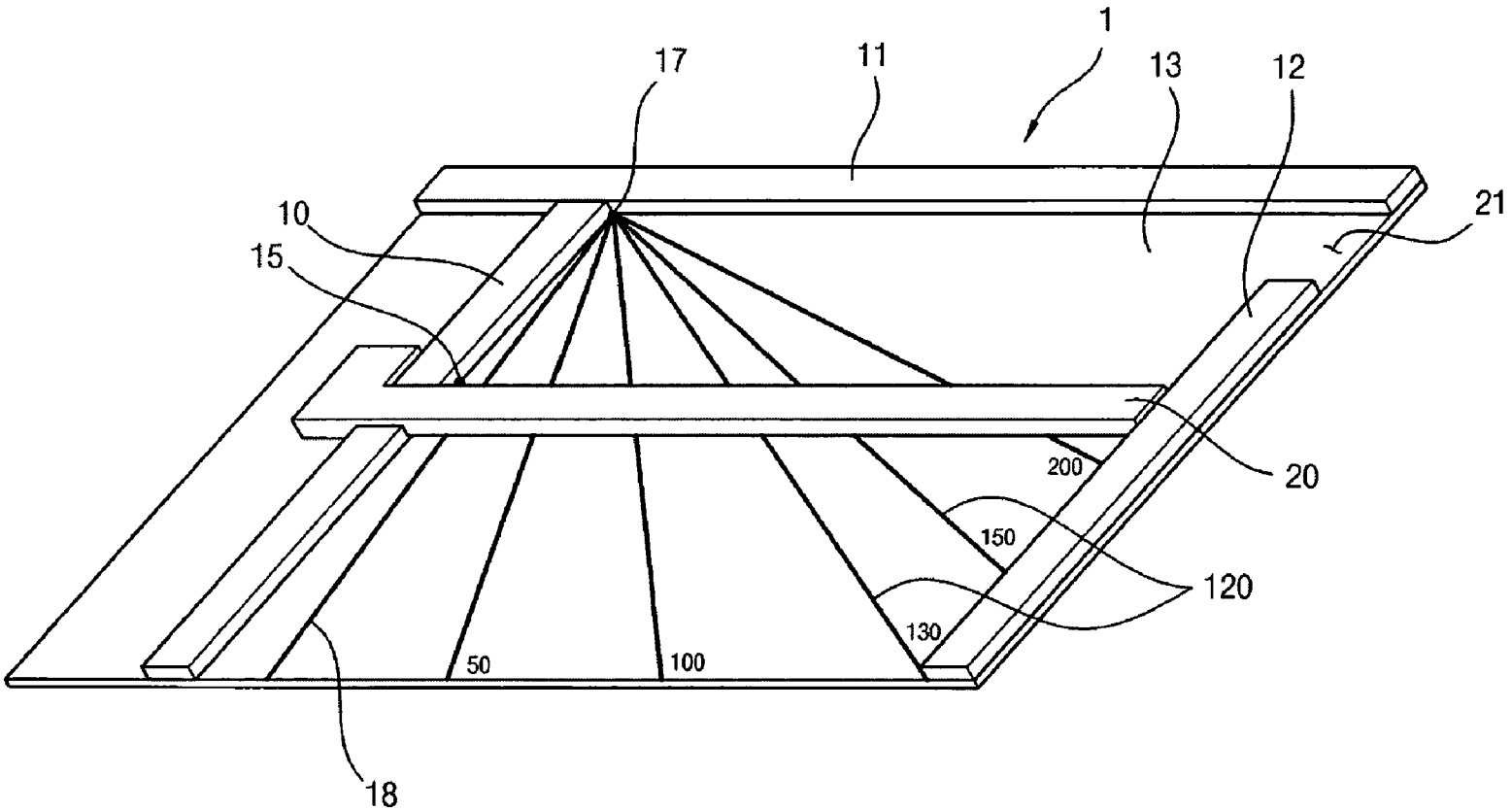
FIG. 4 is a perspective view of a parallelogram counter in which a number of indication lines are drawn according to still another embodiment of the present invention.

FIG. 4 is a perspective view of a parallelogram counter in which a number of indication lines are drawn according to still another embodiment of the present invention. A certain number of pills are arranged along the first longitudinal flange 10, and then the slidable transverse flange 20 is fixed. A number of indication lines 120 are drawn by connecting a straight line obtained by connecting points where a certain number of pills such as the fifth pill from the right-hand side of the vertex 15, the tenth pill, etc., with the reference point 17, to the lower end of the counting plate 13. Then, the total number of the corresponding pills is indicated on the counting plate 13. As a result, the total number of the pills can be seen via the indication lines 120 without counting the number of pills to thereby reduce inconveniences that the number of lines or the total number of the corresponding pills which should be counted, and heighten an efficiency of a counting work in a drug store.

The numbers which are written near the indication lines 120 may indicate the numbers of lines which are arranged horizontally instead of the total numbers of the corresponding pills. In this case, it is preferable that the number of pills per line is fixed and the total number of the corresponding pills should be written.

Figure 5:
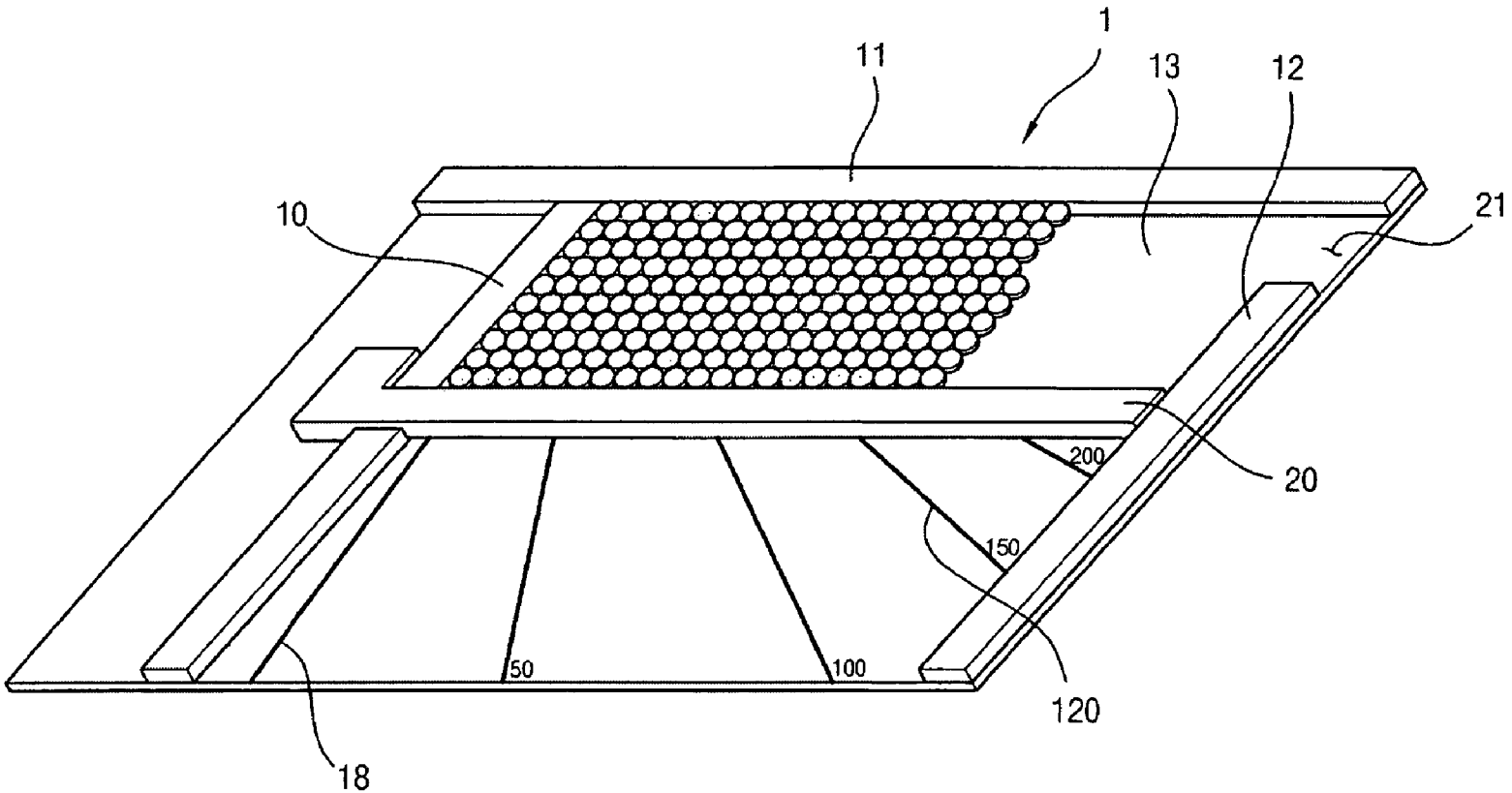
FIG. 5 is a perspective view of the parallelogram counter in which a number of pills each of which the diameter is 6.5 mm are arranged according to the embodiment of the present invention.
Figure 6:
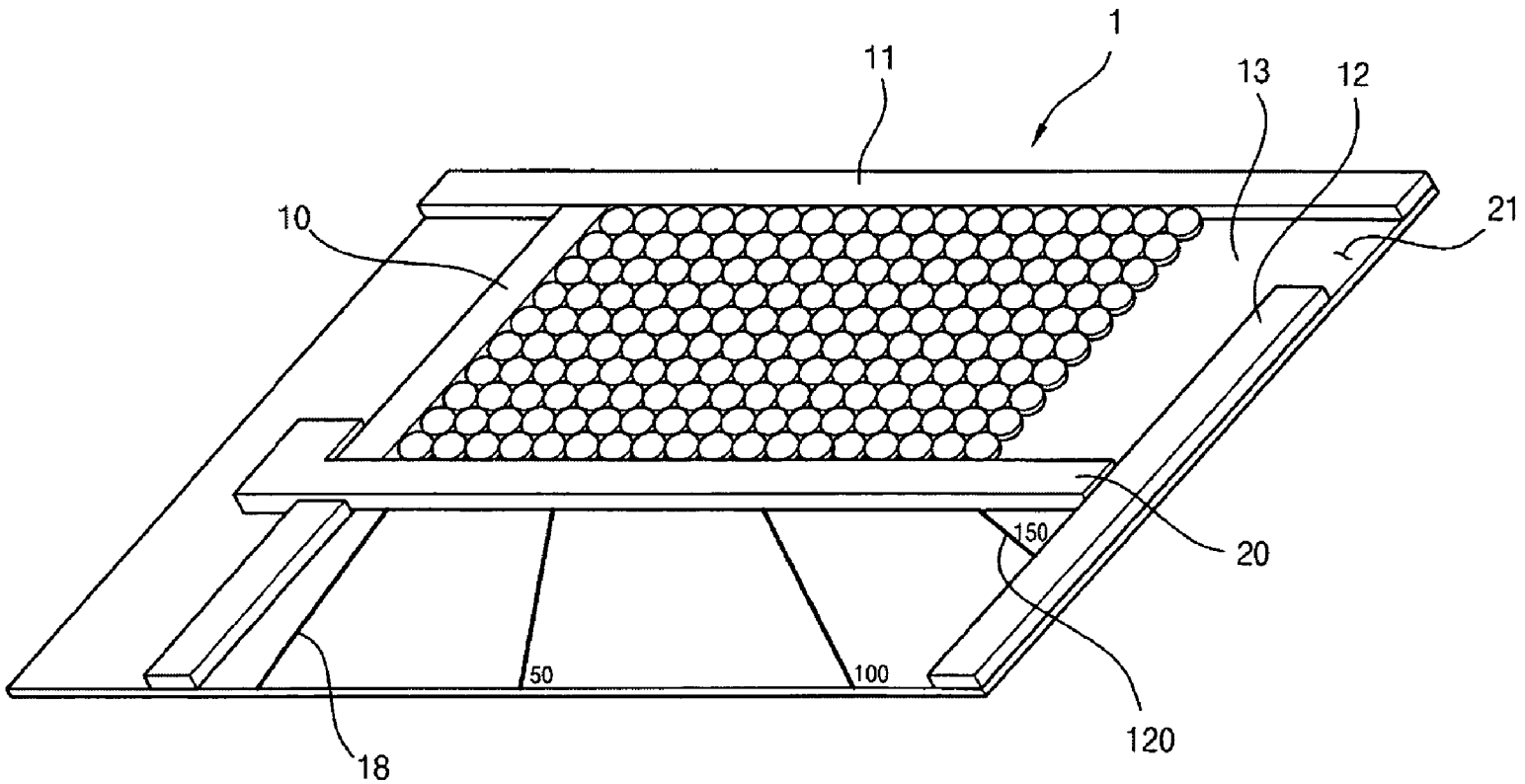
FIG. 6 is a perspective view of the parallelogram counter in which a number of pills each of which the diameter is 9.0 mm are arranged according to the embodiment of the present invention.

FIG. 5 is a perspective view of the parallelogram counter in which a number of pills each of which the diameter is 6.5 mm are arranged according to the embodiment of the present invention, and FIG. 6 is a perspective view of the parallelogram counter in which a number of pills each of which the diameter is 9.0 mm are arranged according to the embodiment of the present invention. As shown in FIGS. 5 and 6, if the slidable transverse flange 20 is moved up and down and fixed at a point where the outer side of the pills concurs with the reference line 18, it can be seen that ten pills which correspond to the reference number have been arranged along the first longitudinal flange 10 irrespective of the size of the pills although the diameter of the pills is changed.

Therefore, a counting work can be easily performed by multiplying ten which correspond to the reference number by the number of lines which are arranged along the slidable transverse flange 20. In FIG. 5, 10×20+6=206, and in FIG. 6, 10×18=180, in order to easily count the number of pills.

Therefore, it is preferable that the reference number is generally set to ten in order to determine the number of pills.

Moreover, the number of the arranged lines can be determineed without counting the lines by using the indication lines 120 drawn to the right-hand side of the reference line 18. In FIG. 5, 200+6=206, and in FIG. 6, 150+30=180, to thereby count the number of pills more conveniently.

Figure 7:
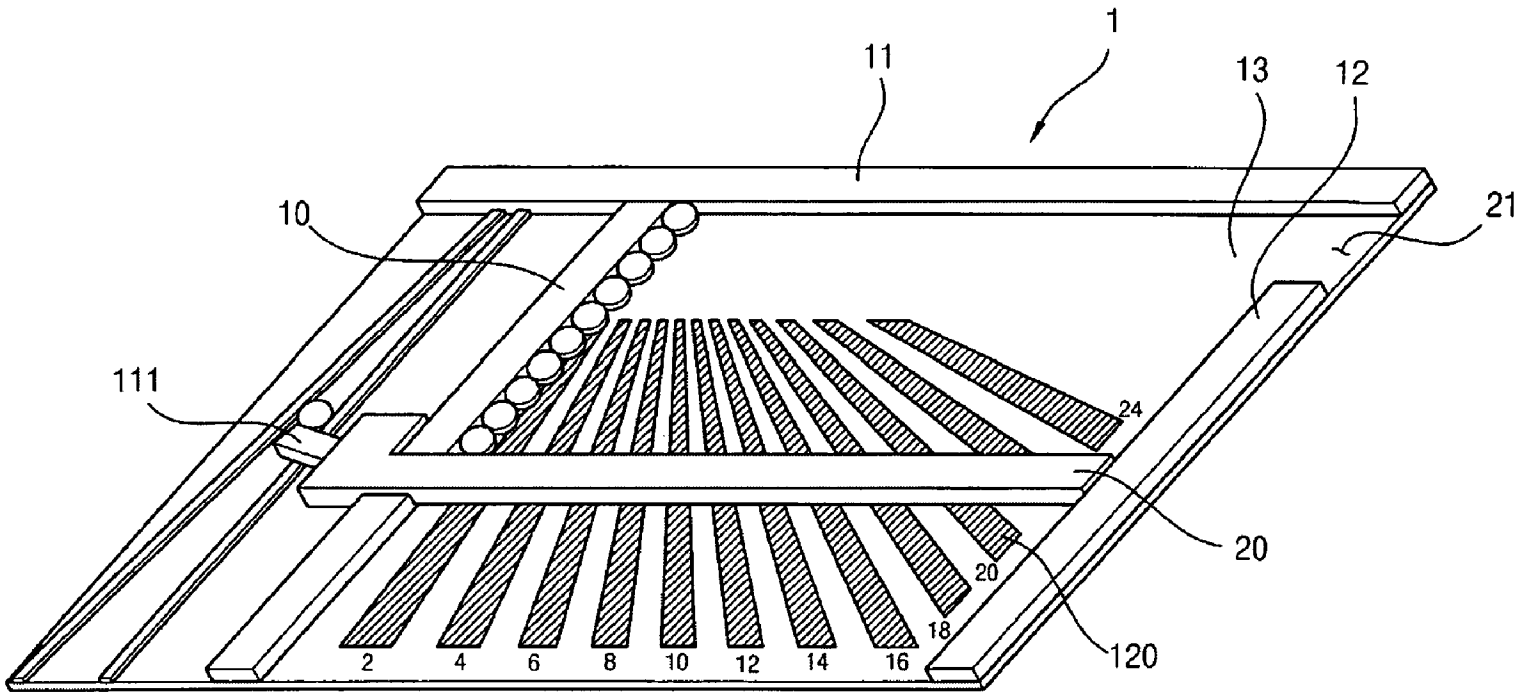
FIG. 7 is a perspective view of a parallelogram counter in which a number of indication lines are drawn according to yet another embodiment of the present invention.

FIG. 7 is a perspective view of a parallelogram counter in which a number of indication lines are drawn according to yet another embodiment of the present invention. In FIG. 7, the indication lines 120 are conspicuously drawn in the form of thick straps and with shades, in order to make a user determine the number of the lines easily and quickly. The indication lines 120 are provided to make the user easily determine the number of pills. Accordingly, the indication lines 120 can be drawn and written in various forms. For example, the indication lines 120 can be formed in various kinds of methods such as a method of writing the number of pills near every indication line 120, a method of writing the number of pills near every other fifth indication line 120, a method of painting the ground of the counting plate 13 in units of two lines so as to be discriminated by colors such as black and white, in order to make the odd-numbered lines and the even-numbered lines easily discriminated, and a method of making only the indication lines 120 representing fifty, one-hundred and the frequently used numbers thicker than the others or painted into the conspicuous colors. The above-described methods of making the indication lines 120 can be applied according to the user's tastes or conditions.

Figure 8:
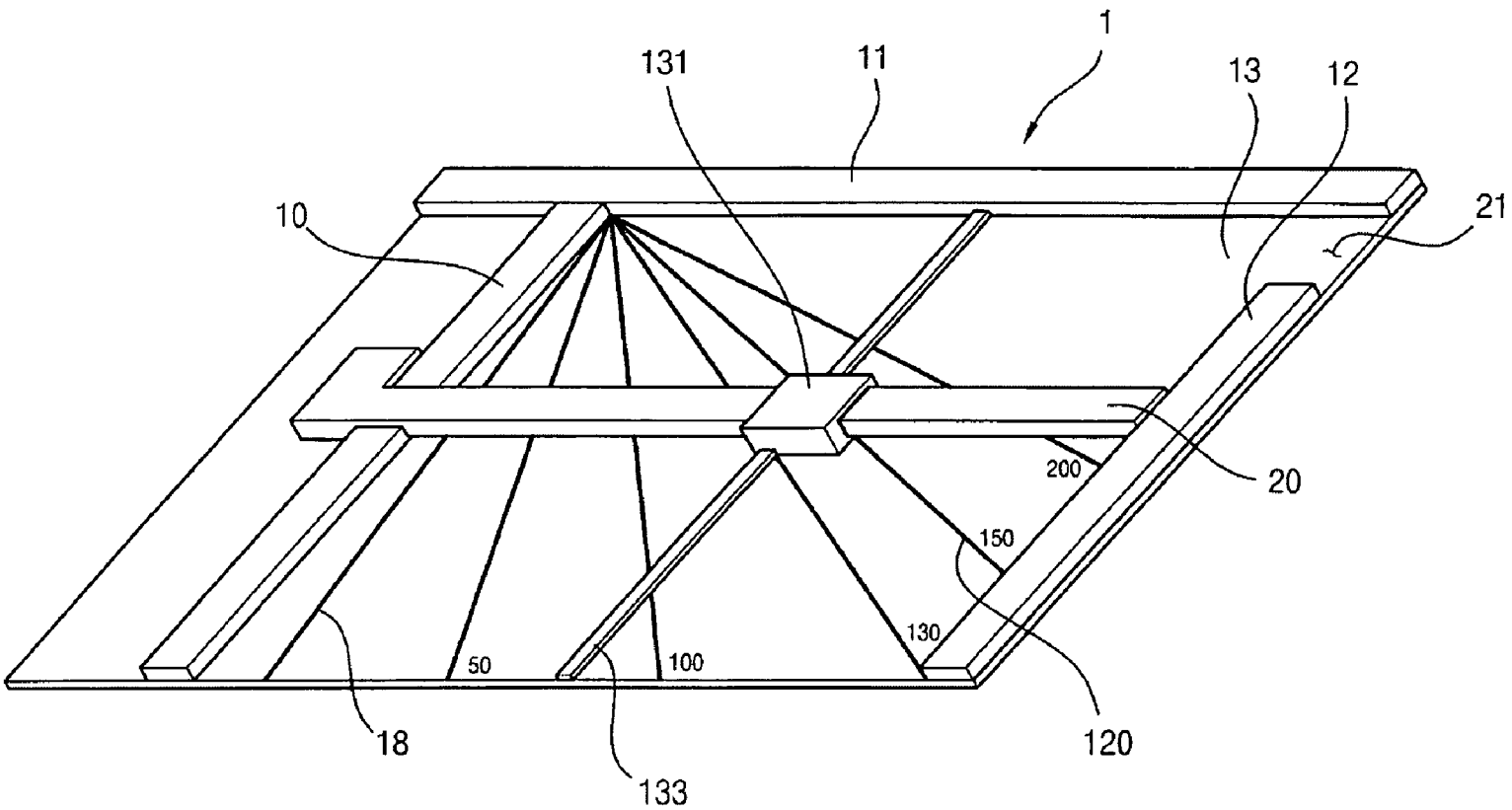
FIG. 8 is a perspective view of a parallelogram counter in which a slidable longitudinal flange is mounted according to a further embodiment of the present invention.

FIG. 8 is a perspective view of a parallelogram counter in which a slidable longitudinal flange is mounted according to a further embodiment of the present invention. In FIG. 8, a slidable transverse plate 131 is fixed so as to be movable to the left and right along the slidable transverse flange 20. A slidable longitudinal flange 133 is formed in parallel with the first longitudinal flange 10 between the slidable transverse flange 20 and the counting plate 13, and is coupled with the slidable transverse plate 131 so as to be movable to the left and right. The slidable longitudinal flange 133 can be attached to and detached from the parallelogram counter 1 according to the present invention.

In the case of taking necessary pills the slidable transverse flange 20 is made to be fixed at a position matching the size of the pills and the slidable longitudinal flange 133 is made to be fixed at an indication line 120 corresponding to the necessary number of pills. Thereafter, only the necessary number of pills are arranged at the left-hand side of the slidable longitudinal flange 133, and then the remaining number of the pills are easily discharged via a recollection outlet 21 using a recollector 140. Accordingly, a desired number of pills can be easily taken. The discharged pills and the counted pills are moved to a vial through the recollection outlet 21 or are able to make the most for a preparation.

Moreover, the slidable longitudinal flange 133 can be attached to and detached from the slidable transverse flange 20 in the parallelogram counter 1 according to the present invention. Accordingly, the parallelogram counter 1 according to the present invention can be conveniently used.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

As described above, the parallelogram counter 1 according to the present invention utilizes the reference line 18 in the parallelogram counting plate 13 to thus make the slidable transverse flange 20 moved up and down to then be fixed. Also, the parallelogram counter 1 according to the present invention utilizes the fixed protrusion 111 to thus make the slidable transverse flange 20 moved to then be fixed. Accordingly, a certain number of pills is made to be arranged at the right-hand side of the first longitudinal flange 10.

Also, the parallelogram counter 1 according to the present invention utilizes is made to count the number of lines which are horizontally arranged at the lateral surface of the slidable transverse flange 20, or utilize the indication lines 120, to thereby make a user count pills conveniently and easily, and also make a user count pills quickly, conveniently and hygienically in a pharmacy irrespective of the size of the pills. As a result, an efficiency of prescription in a pharmacy increases and insanitary situations are improved.

What is claimed is:

1. A parallelogram counter counting circular or disc-shaped tablet type pills, beads or coins, the parallelogram counter comprising:

a parallelogram counting plate, on which a transverse flange, a first longitudinal flange, and a second longitudinal flange are protrudingly formed at the upper portion, the left-hand portion, and the right-hand portion of the parallelogram counter, respectively;

a slidable transverse flange which is formed in parallel with the transverse flange, so that the first longitudinal flange is inserted into a throughhole formed on the left-hand side of the slidable transverse flange and the slidable transverse flange is slidably moved up and down along the first longitudinal flange;

a reference point at which the transverse flange and the first longitudinal flange meet;

a reference line which is formed by connecting the reference point with the outer side of a last pill among a reference number of pills which are arranged along the side surface of the first longitudinal flange; and a recollector outlet which is formed between the transverse flange and the second longitudinal flange.

2. The parallelogram counter according to claim 1, further comprising a number of indication lines which are obtained by-continuously drawing straight lines connecting points at which pills of a certain number are arranged to the right side from the vertex in which the upper surface of the slidable transverse flange and the right-hand surface of the first longitudinal flange with the reference point, up to the lower end of the counting plate.

3. The parallelogram counter according to claim 1, further comprising a slidable transverse plate which moves to the left and right along the slidable transverse flange, and a slidable longitudinal flange which is formed between the slidable transverse flange and the counting plate in parallel with the first longitudinal flange, and combined with the slidable transverse plate so as to be movable to the left and right.

4. The parallelogram counter according to claim 2, further comprising a slidable transverse plate which moves to the left and right along the slidable transverse flange, and a slidable longitudinal flange which is formed between the slidable transverse flange and the counting plate in parallel with the first longitudinal flange, and combined with the slidable transverse plate so as to be movable to the left and right.

5. A parallelogram counter counting circular or disc-shaped tablet type pills, beads or coins, the parallelogram counter comprising:

a parallelogram counting plate, on which a transverse flange, a first longitudinal flange, and a second longitudinal flange are protrudingly formed at the upper portion, the left-hand portion, and the right-hand portion of the parallelogram counter, respectively;

a slidable transverse flange which is formed in parallel with the transverse flange, so that the first longitudinal flange is inserted into a throughhole formed on the left-hand side of the slidable transverse flange and the slidable transverse flange is slidably moved up and down along the first longitudinal flange;

a guide plate where two guides are protrudingly formed so that one is formed at the left-hand side in parallel with the first longitudinal flange and the other is formed at the left-hand side of the one guide and spaced by an interval between the first longitudinal flange and the reference line;

a fixed protrusion which is located between the two guides, and is integrally formed in the slidable transverse flange; and a recollector outlet which is formed between the transverse flange and the second longitudinal flange.

6. The parallelogram counter according to claim 1, wherein interior angles between the first longitudinal flange and the transverse flange and between the second longitudinal flange and the transverse flange are one-hundred twenty degrees or sixty degrees, respectively.

7. The parallelogram counter according to claim 5, wherein interior angles between the first longitudinal flange and the transverse flange and between the second longitudinal flange and the transverse flange are one-hundred twenty degrees or sixty degrees, respectively.

8. The parallelogram counter according to claim 1, further comprising a recollector with a grip which is hung up on the counting plate or connected to the counting plate with a string in use.

9. The parallelogram counter according to claim 5, further comprising a recollector with a grip which is hung up on the counting plate or connected to the counting plate with a string in use.

* * * * *